US008287119B2

(12) United States Patent
Yamaguchi et al.

(10) Patent No.: US 8,287,119 B2
(45) Date of Patent: Oct. 16, 2012

(54) PRINTER

(75) Inventors: Toshiaki Yamaguchi, Machida (JP); Yoshihiro Koyama, Yokohama (JP); Norio Sasaki, Chigasaki (JP); Shinji Toyoshima, Kawasaki (JP); Yukimichi Kimura, Kawasaki (JP); Yutaka Hokazono, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 333 days.

(21) Appl. No.: 12/707,611

(22) Filed: Feb. 17, 2010

(65) Prior Publication Data

US 2010/0214343 A1 Aug. 26, 2010

(30) Foreign Application Priority Data

Feb. 20, 2009 (JP) ..... 2009-038050

(51) Int. Cl.
*B41J 2/01* (2006.01)

(52) U.S. Cl. ..... 347/104

(58) Field of Classification Search ..... 347/16, 347/84, 85, 104, 101
See application file for complete search history.

(56) References Cited

U.S. PATENT DOCUMENTS 6,070,977 A * 6/2000 Nuita et al. ..... 347/104
7,431,278 B2 * 10/2008 Hiraki et al. ..... 271/3.14
7,887,179 B2 * 2/2011 Toyoshima ..... 347/104

FOREIGN PATENT DOCUMENTS

JP 2007-331255 A 12/2007

* cited by examiner

*Primary Examiner* — An Do
(74) *Attorney, Agent, or Firm* — Canon USA Inc IP Division

(57) ABSTRACT

An ink jet printer includes a platen including an attraction portion for attracting a sheet and a sheet support surface in which an collection opening for collecting ink discharged outside the sheet is formed, a negative pressure generation mechanism configured to be used in common to generate a negative pressure to be supplied to each of the attraction portion and the collection opening, a first duct configured to connect the negative pressure generation mechanism and the attraction portion, a second duct configured to connect the negative pressure generation mechanism and the collection opening, and an adjustment mechanism configured to ununiformly change a negative pressure to be supplied to the attraction portion through the first duct and a negative pressure to be supplied to the collection opening through the second duct.

15 Claims, 13 Drawing Sheets

PRINTER

BACKGROUND OF THE INVENTION

1. Field of the Invention

The present invention relates to an ink jet printer that performs printing on a sheet supported by a platen.

2. Description of the Related Art

Many ink jet printers include a platen for supporting and positioning a conveyed sheet at a printing position. When so-called borderless printing is performed and when the printing is performed on an end portion of the sheet, ink may be applied outside the sheet and adhered onto a surface of the platen.

If the next printing is performed on the sheet having a different size before the ink gets dry, the ink is adhered onto a rear surface of the sheet and stains it. To address this problem, a structure is known in which a collection opening for collecting the ink discharged outside the sheet is formed in a sheet supporting surface of the platen.

Since a distance between an ink discharge hole of a print head and a collection opening of the platen is long, a part of the ink discharged outside the sheet when the borderless printing is performed may become floating ink mist (including ink satellite). The floating ink mist can cause stains on the inside of the printer, for example, on the platen and the rear side of a media nearby.

Japanese Patent Application Laid-Open No. 2007-331255 discusses an apparatus in which the generated floating ink mist is collected by suction with a suction fan inside the collection opening, thereby preventing the floating ink mist from scattering. Further, the apparatus uses the same fan to attract the sheet onto the platen.

In the apparatus discussed in Japanese Patent Application Laid-Open No. 2007-331255 described above, a common suction fan uniformly attracts the sheet onto the platen and suctions the ink mist from the collection opening. However, a method is not discussed for ununiformly and individually adjusting a negative pressure to each of the purposes described above.

Accordingly, when the borderless printing is performed and even when bordered printing without necessity of suction from the collection opening is performed, the suction is always performed with a highest ability, thus continuing to generate a big noise of the fan. However, if the mechanisms such as the suction fan are separately provided to attract the sheet and collect the ink mist from the collection opening, the noise will be further worsened, and a size and a cost of the apparatus will be increased.

SUMMARY OF THE INVENTION

The present invention is directed to a printer that can securely support a sheet on a platen and decrease to generate mist when borderless printing is performed, and further can decrease a size and a cost of a printer while decreasing a noise.

According to an aspect of the present invention, an ink jet printer includes a platen including an attraction portion configured to attract a sheet and a sheet support surface in which an collection opening for collecting ink discharged outside the sheet is formed, a negative pressure generation mechanism configured to be used in common to generate a negative pressure to be supplied to each of the attraction portion and the collection opening, a first duct configured to connect the negative pressure generation mechanism and the attraction portion, a second duct configured to connect the negative pressure generation mechanism and the collection opening, and an adjustment mechanism configured to ununiformly change a negative pressure to be supplied to the attraction portion through the first duct and a negative pressure to be supplied to the collection opening through the second duct.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings. However, the structural elements described in the exemplary embodiments are just examples and do not intend to limit the scope of the present invention thereto.

An ink jet printer will be described as an example below. However, the printer of the present invention can be also applied to a multifunction peripheral (also referred to as a multifunction printer) having a copy function and a scanning function. In this specification, a sheet means a print medium shaped in a sheet of paper, plastic, or cloth.

Figure 1:
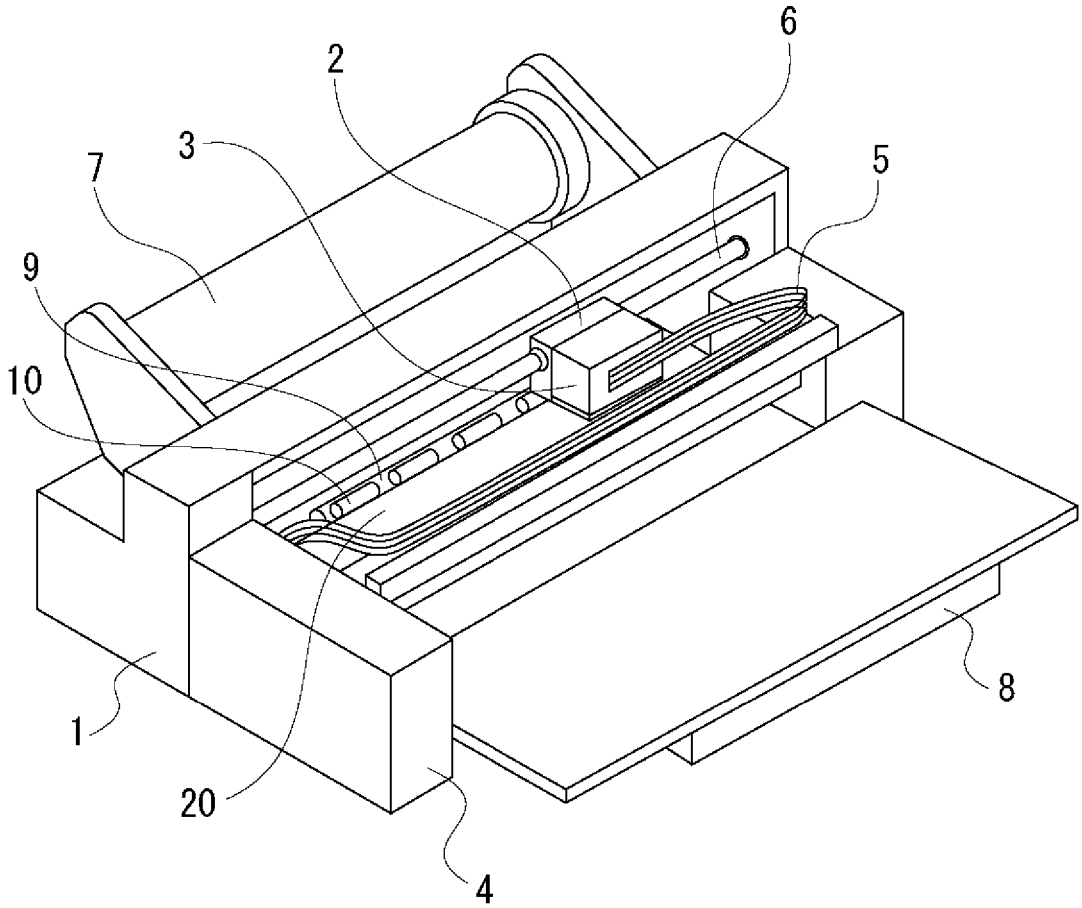
FIG. 1 is a perspective view illustrating a structure of an ink jet printer.
Figure 2:
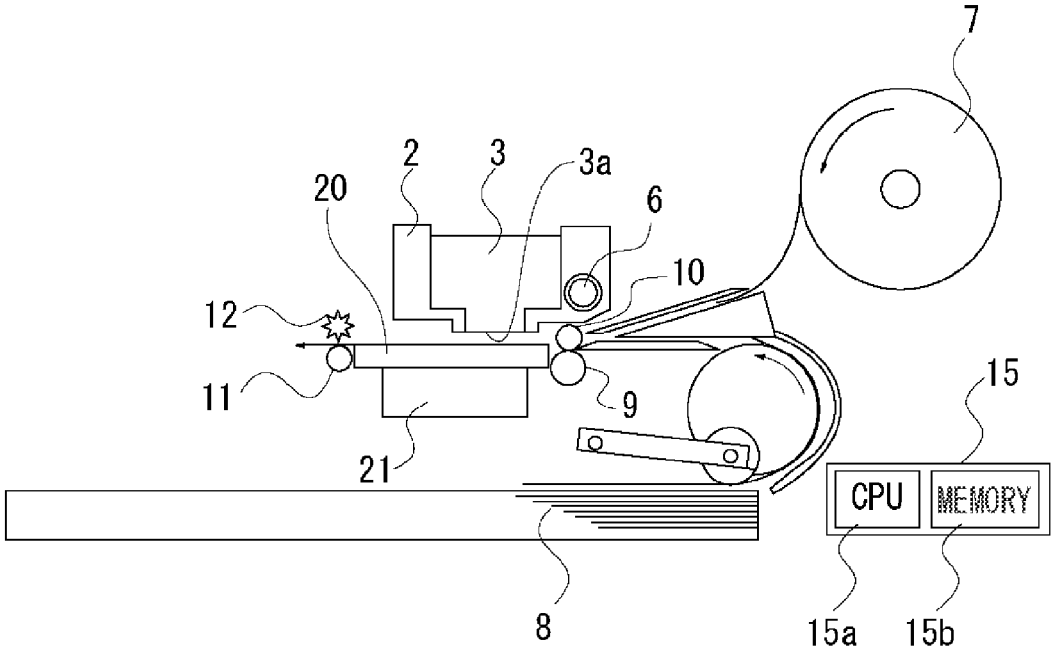
FIG. 2 is a cross sectional view illustrating an inside of the printer illustrated in FIG. 1.

FIG. 1 is a perspective view illustrating an entire structure of an ink jet printer according to the present exemplary embodiment. FIG. 2 is a cross sectional view illustrating an inside of the printer illustrated in FIG. 1. Roughly, a body of an apparatus 1 includes a print unit and a sheet supply unit.

The print unit includes a carriage 2 that reciprocates in a main scanning direction and a print head 3 mounted thereon. The print head 3 includes a nozzle array that discharges inks corresponding to a plurality of colors by an ink jet method. As an energy generating element for discharging the ink, the ink jet method can use varieties of methods by using, for example, a heater, a piezo element, an electrostatic element, or a micro electro mechanical systems (MEMS) element.

An ink tank 4 supplies to the nozzle array the inks respectively having corresponding colors through each supply tube 5. The carriage 2 can move along a guide shaft 6 fixed to a frame of the printer body at both ends portion and reciprocates by a driving mechanism including a motor and a belt.

A platen 20 that supports a conveyed sheet at a printing position is disposed opposing a nozzle face 3*a* of the print head 3. The platen 20 attracts the sheet onto a surface thereof by a mechanism described below. A duct 21 for suctioning the air is disposed beneath the platen 20.

A structure of the duct 21 will be described in detail below. A controller 15 includes a central processing unit (CPU) 15*a*, a memory 15*b*, and various types of input/output (I/O) interfaces. The controller 15 performs various kinds of controls over the entire printer and is built in the body of the printer.

The sheet supply unit includes a holder for holding a roll sheet 7 and a holder for layering and holding a cut sheet (or cut sheets) 8. The controller performs control such that the sheet stored in either one of the holders is fed to the print unit. The roll sheet 7 is rotatably held by the holder. The sheet withdrawn from the holder is pinched between a conveyance roller 9 and a pinch roller 10 driven by the conveyance roller 9.

A plurality of cut sheets 8 are layered and stored in a cassette. Similarly, each sheet that is separated and withdrawn therefrom is pinched between the conveyance roller 9 and the pinch roller 10 driven by the conveyance roller 9. The conveyance roller 9 and the pinch roller 10 are a part of a sheet conveyance mechanism. The sheet pinched thereby is conveyed onto a surface of the platen 20 by the rotation of the conveyance roller 9.

The print unit performs printing of an image on the sheet being conveyed on the platen 20 in a sub-scanning direction. The printing is performed using a so-called serial type printing method in which the printing by the main scanning for one band of the print head 3 performed by the carriage 2 and a predetermined amount of sheet conveyance performed by the conveyance roller 9 are alternately, repeatedly performed.

The present invention is not limited to the serial printer but can be also applied to a line printer. For the line printer, as the print head, a long line type head that covers a print range in the main scanning direction. The printed sheet is discharged by a discharge roller 11 and a spur 12 in an arrow direction illustrated in FIG. 2.

The several variations of the structures of the platen 20 and the duct 21 will be described below. However, the entire structure of the printer is as described above in any exemplary embodiment. The printer of the present exemplary embodiment can perform borderless printing by which the print can be performed on an end portion of the sheet without a margin.

Any platen described below includes a collection opening for collecting the ink discharged outside the sheet when the borderless printing is performed and a sheet support surface on which an attraction portion for attracting the conveyed sheet is formed.

Figure 3:
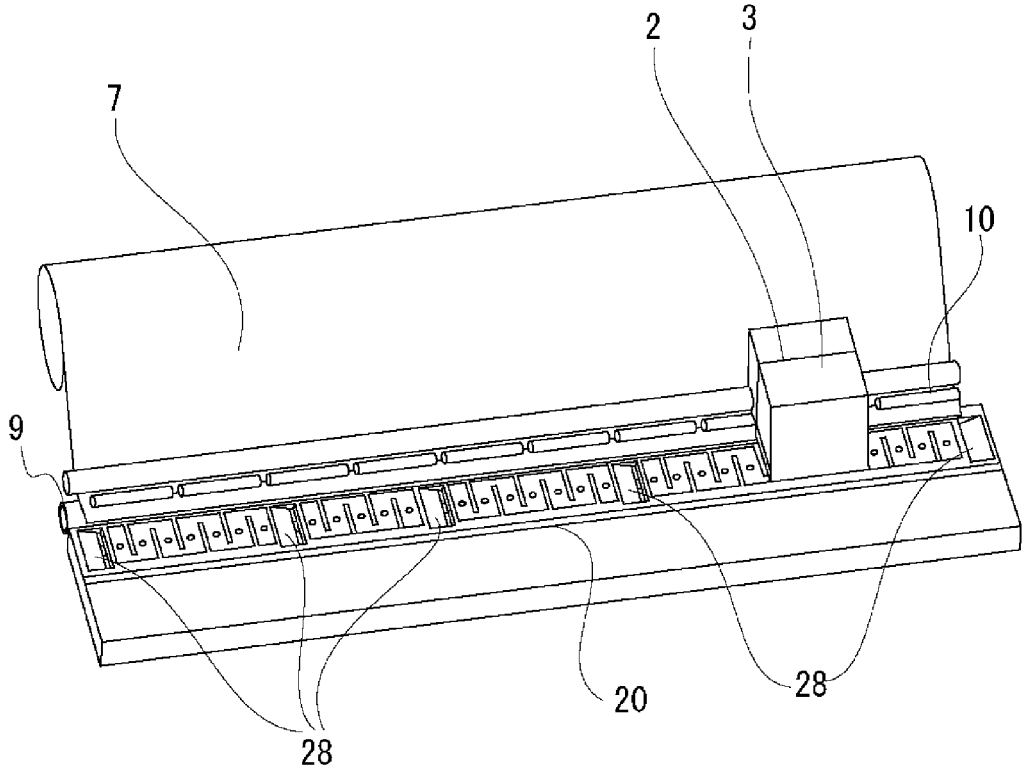
FIG. 3 is a perspective view illustrating a main portion of the printer around a platen.
Figure 4:
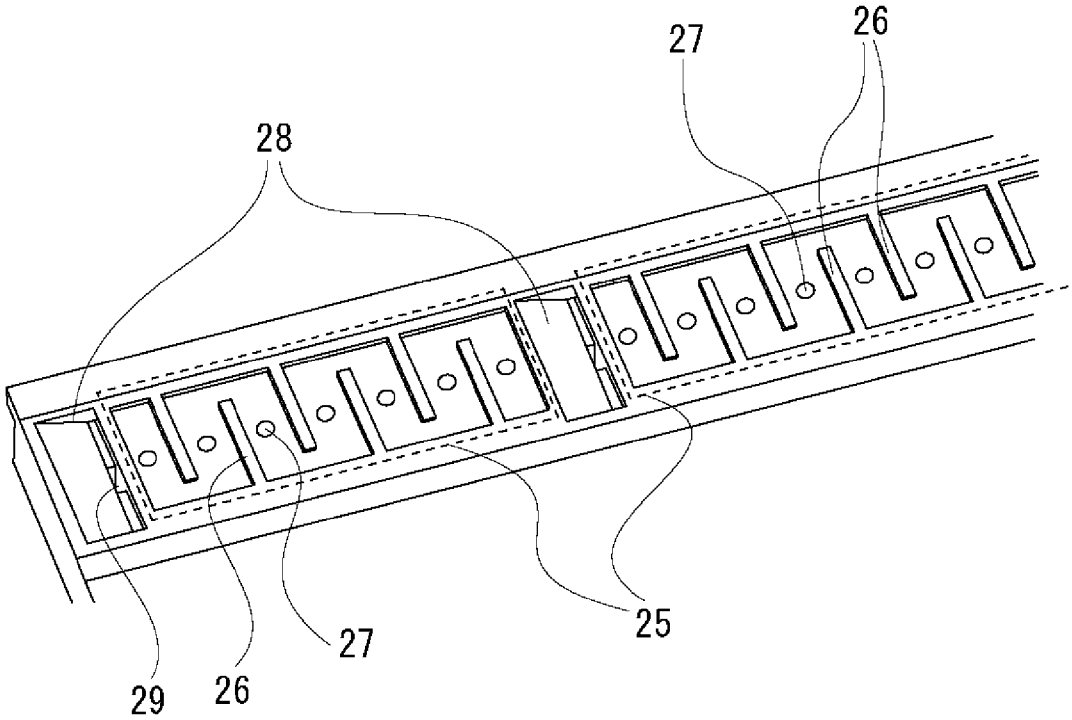
FIG. 4 is an enlarged view illustrating the platen.

FIG. 3 is a perspective view illustrating a main portion of the printer around the platen 20. FIG. 4 is an enlarged view illustrating a surface of the platen 20. FIG. 3 illustrates a state in which the roll sheet 7 is supplied. When the cut sheet 8 is supplied, a structure and an operation are similar to those described below.

An attraction portion 25 for attracting the sheet is formed along the main scanning direction on the sheet support surface of the platen 20. One unit of the attraction portion 25 indicated by the dotted lines in FIG. 4 includes a pair of ribs bipectinately meshed with each other and a suction hole 27 that is provided in each position where the ribs 26 are meshed with each other and supplies a negative pressure by suctioning the air.

The negative pressure is supplied through the suction hole 27 to a space formed by projections of the pair of ribs 26 located on opposite side with each other. The sheet is attracted to the attraction portion 25 and closely contacted onto an upper surface of the rib 26 and supported thereon.

Further, a collection opening 28 for collecting the ink discharged outside the sheet when the borderless printing is performed is formed in the sheet support surface of the platen 20 at both ends of the platen 20 and between the units of the attraction portions 25. The collection opening 28 is provided at a plurality of positions for dealing with a plurality of sheet sizes that are expected to be used. Thus, printing without borders at both ends can be performed for the sheet having any size.

Corresponding to each collection opening 28, a suction hole 29 for supplying the negative pressure for collecting the discharged ink and suctioning floating ink mist is provided. A bottom surface of the collection opening 28 has a slope, and the discharged ink flows down on the slope to the suction hole 29 and is collected.

Figure 5:
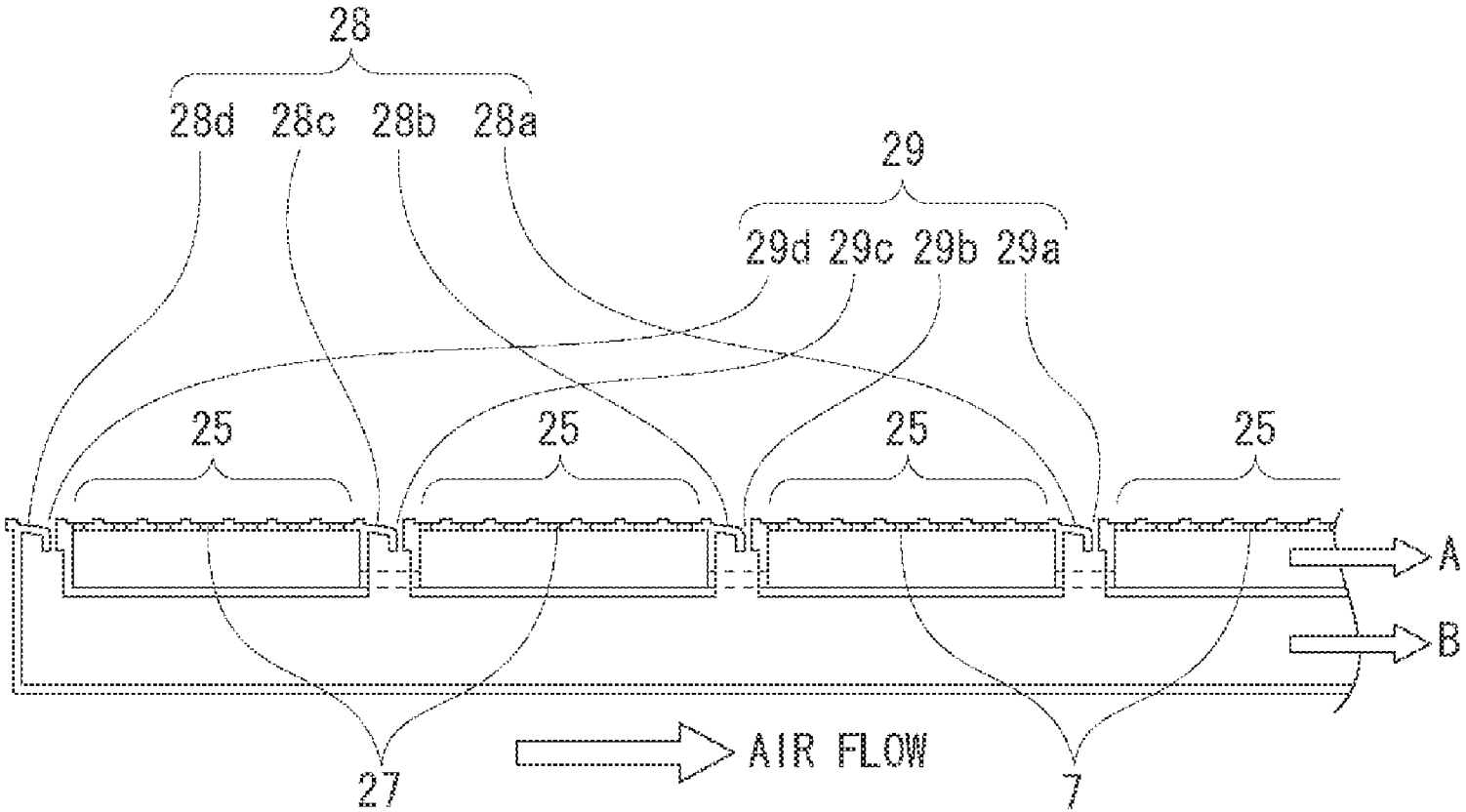
FIG. 5 illustrates a structure of a duct that supplies a negative pressure to an attraction portion and a collection opening.

With reference to FIG. 5, a structure of the duct 21 for supplying the negative pressure to the attraction portion 25 and the collection opening 28 will be described.

A duct "A" (first duct) supplies the negative pressure to each unit of the attraction portion 25. The each unit of the attraction portion 25 is a chamber independent from each other. The sheet support surface including the suction hole 27 and the rib 26 is formed on the upper surface of the each chamber. A plurality of chambers are connected in series. An air current is generated by a negative pressure generation mechanism in an arrow direction of the duct "A" to supply the negative pressure to each attraction portion 25.

On the other hand, the duct "B" (second duct) supplies the negative pressure to a plurality of collection openings 28. The air current is generated by the negative pressure generation mechanism in an arrow direction of the duct "B" to supply the negative pressure to each collection opening 28*a*, 28*b*, 28*c*, and 28*d* through each suction hole 29*a*, 29*b*, 29*c*, and 29*d*.

Figure 6:
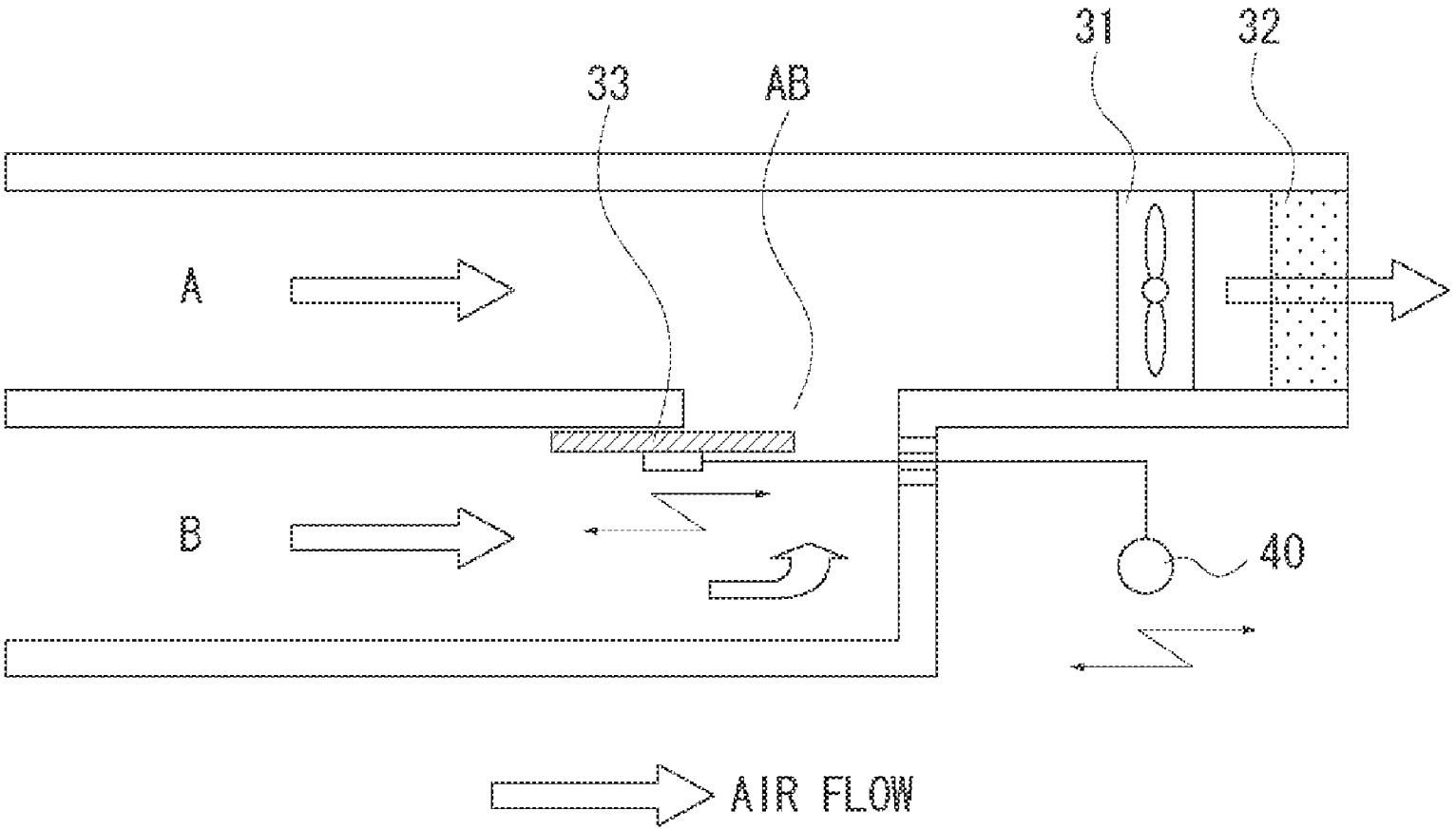
FIG. 6 illustrates a structure of a merging section of the ducts "A" and "B", and the negative pressure generation mechanism.

FIG. 6 illustrates a structure of a merging section of the ducts "A" and "B", and a negative pressure generation mechanism. The negative generation mechanism includes a fan 31 for generating the air current by rotation and the filter 32. As the fan 31, a sirocco fan is used to realize the high negative pressure in a saved small space. The air is suctioned by the fan 31, the floating ink mist in the air is trapped by the filter 32, and the air is discharged from the printer.

The duct "B" merges with the duct "A" on a half way thereof at a merging section AB and is connected to the common negative pressure generation mechanism. In this specification, the duct "A" from the attraction portion 25 to the negative pressure generation mechanism is referred to as the first duct, and the duct including the duct "B" and a part of the merged duct with the duct "A" ahead of the duct "B" from the collection opening 28 to the negative pressure generation mechanism is referred to as the second duct.

An aperture mechanism 33 that is manually opened/closed by a user is disposed near the merging section AB. The user operates an open/close lever 40 that can be accessed from an outside of the printer by the user to continuously change an opening of the aperture mechanism 33 from a fully-closed state (resistance in a flow path of the second duct is large up to infinity) to a fully-opened state (resistance in the flow path of the second duct is smallest). More specifically, the aperture mechanism 33 can change an opening area of a part of a middle portion of the second duct (the merging section AB).

By using an adjustment mechanism including the aperture mechanism 33 and the open/close lever 40, the negative pressure to be supplied to the attraction portion 25 through the first duct and the negative pressure to be supplied to the collection opening 28 through the second duct can be ununiformly and individually adjusted. A sensor can automatically detect the opening/closing state of the aperture mechanism 33, thus prompting the user to adequately operate the open/close lever 40 according to a mode.

A rotation speed (a number of rotations) of the fan 31 can be changed by a control command of the controller 15 to change ability for generating the negative pressure. More specifically, by changing the ability of the negative pressure generation mechanism, at least, the negative pressure to be supplied to the attraction portion 25 through the first duct can be adjusted.

The negative pressure generation mechanism is not limited to the fan 31 for generating the air current in the duct, and any mechanism will work fine as long as the mechanism can generate the negative pressure in the duct. Further, the aperture mechanism 33 is not limited to a shutter mechanism in which a flat plate moves, and a mechanism having a circle aperture or a mechanism having cylindrical aperture that have a plurality of diaphragm blades may be useful. The mechanisms described above can be similarly adopted in other exemplary embodiments described below.

An operation of the apparatus having the structure described above will be described. To prevent the sheet from floating above while the printing operation is performed, the fan 31 of the negative pressure generation mechanism is operated to attract the sheet "S" onto the attraction portion 25 so that the platen 20 supports the sheet "S".

The controller 15 changes the negative pressure generated by the negative pressure generation mechanism according to the set mode. As one of the specific examples, a rotation speed of the fan 31 is changed according to characteristics of the sheet to be used. For example, when the sheet to be used is thick, highly rigid, or strongly curled, a rotation speed of the fan 31 is increased to generate the relatively larger negative pressure to decrease float of the sheet to support the sheet with a relatively strong attraction force.

On the other hand, when the sheet to be used is thin and low rigid, the rotation speed of the fan 31 is decreased to improve conveyance accuracy and generate a relatively small negative pressure to support the sheet with a relatively small attraction force.

Before the print operation is started, the controller 15 prompts the user to perform an appropriate operation by grasping the opening/closing state of the aperture mechanism 33 so that the aperture mechanism position according to the predetermined print condition of the border/borderless printing can be obtained. More specifically, the user is prompted to operate the open/close lever 40 to change the state of the aperture mechanism 33 depending on the border/borderless printing.

When the borderless printing is performed, the aperture mechanism 33 is opened to supply the negative pressure to the collection opening 28. With this arrangement, the floating ink mist generated when the ink is discharged outside the sheet is suctioned into the negative pressure generation mechanism side through the suction hole 29 and is trapped by the filter 32.

On the other hand, when the bordered printing is performed, since the floating ink mist is not generated in the collection opening 28, the aperture mechanism 33 is fully or partly closed to decrease the supply of the negative pressure to the collection opening 28. When the aperture mechanism 33 is closed, the negative pressure is more efficiently supplied to the attraction portion 25. Therefore, to obtain the necessary attraction force at the attraction portion 25, a rotation speed of the fan 31 can be decreased compared with that when the borderless printing is performed, thereby decreasing the generation of the noise of the fan 31.

The controller 15 controls the aperture mechanism 33 and the fan 31 according to the following combinations of the four cases. A large, middle, and small rotation speeds of the fan are relative, and rotation speeds of the fan for case (2) and case (3) (both are middle) may be different.

(1) borderless printing/high rigid sheet:aperture mechanism open/a large rotation speed of the fan
(2) borderless printing/low rigid sheet:aperture mechanism open/a middle rotation speed of the fan
(3) bordered printing/high rigid sheet:aperture mechanism closed/a middle rotation speed of the fan
(4) bordered printing/low rigid sheet:aperture mechanism closed/a small rotation speed of the fan As described above, the common negative pressure generation mechanism supplies the negative pressure to the attraction portion 25 and the collection opening 28, and further the adjustment mechanism individually changes the negative pressure to be supplied to each of the attraction portion 25 and the collection opening 28. Thus, when each of the bordered printing and the borderless printing is performed, the sheet can be attracted with the appropriate force and the generation of the mist in the collection opening 28 can be decreased.

Further, a rotation speed of the fan is appropriately changed, thereby decreasing the generation of the noise of the fan. In addition, since the negative pressure generation mechanism can be used in common, the above-described operation effects can be realized while the size and the costs of the apparatus are decreased.

Figure 7:
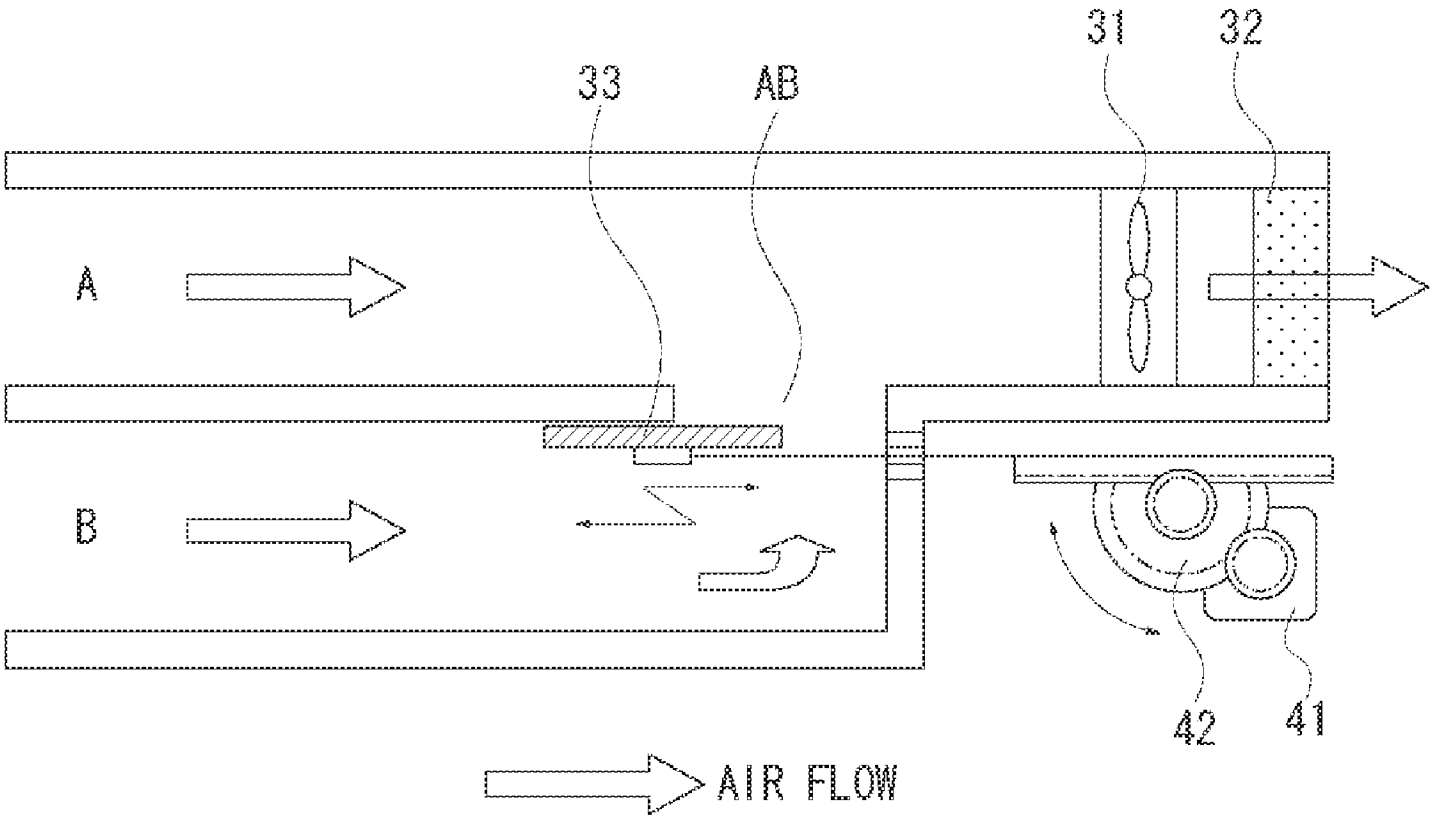
FIG. 7 illustrates a structure of the ducts according to a second exemplary embodiment.

FIG. 7 illustrates a structure of the ducts according to a second exemplary embodiment. The second exemplary embodiment is different from the first exemplary embodiment illustrated in FIG. 6 in that the aperture mechanism 33 is automatically driven by an actuator.

The aperture mechanism 33 disposed near the merging section AB of the ducts "A" and "B" is moved right and left to be automatically opened/closed by the actuator including a driving source 41 including a stepping motor and a rack and pinion mechanism 42 according to an instruction of the controller 15. The opening of the aperture mechanism 33 can be continuously changed from the fully-closed state to the fully-opened state by the actuator.

More specifically, the aperture mechanism 33 can change the opening area of a part of the middle portion of the second duct (the merging section AB). The adjustment mechanism including the aperture mechanism 33 and the actuator can ununiformly and individually adjust the negative pressure to be supplied to the attraction portion 25 through the first duct and the negative pressure to be supplied to the collection opening 28 through the second duct.

The actuator is controlled according to the instruction of the controller 15. Since other structures and operations are similar to those of the first exemplary embodiment, the descriptions will not be repeated.

According to the present exemplary embodiment, in addition to the effects of the previous exemplary embodiment, since the opening/closing of the aperture mechanism 33 can be automatically performed, the user does not need to manually operate the apparatus. Thus, the highly-automated printer having great conveniences can be provided.

Figure 8:
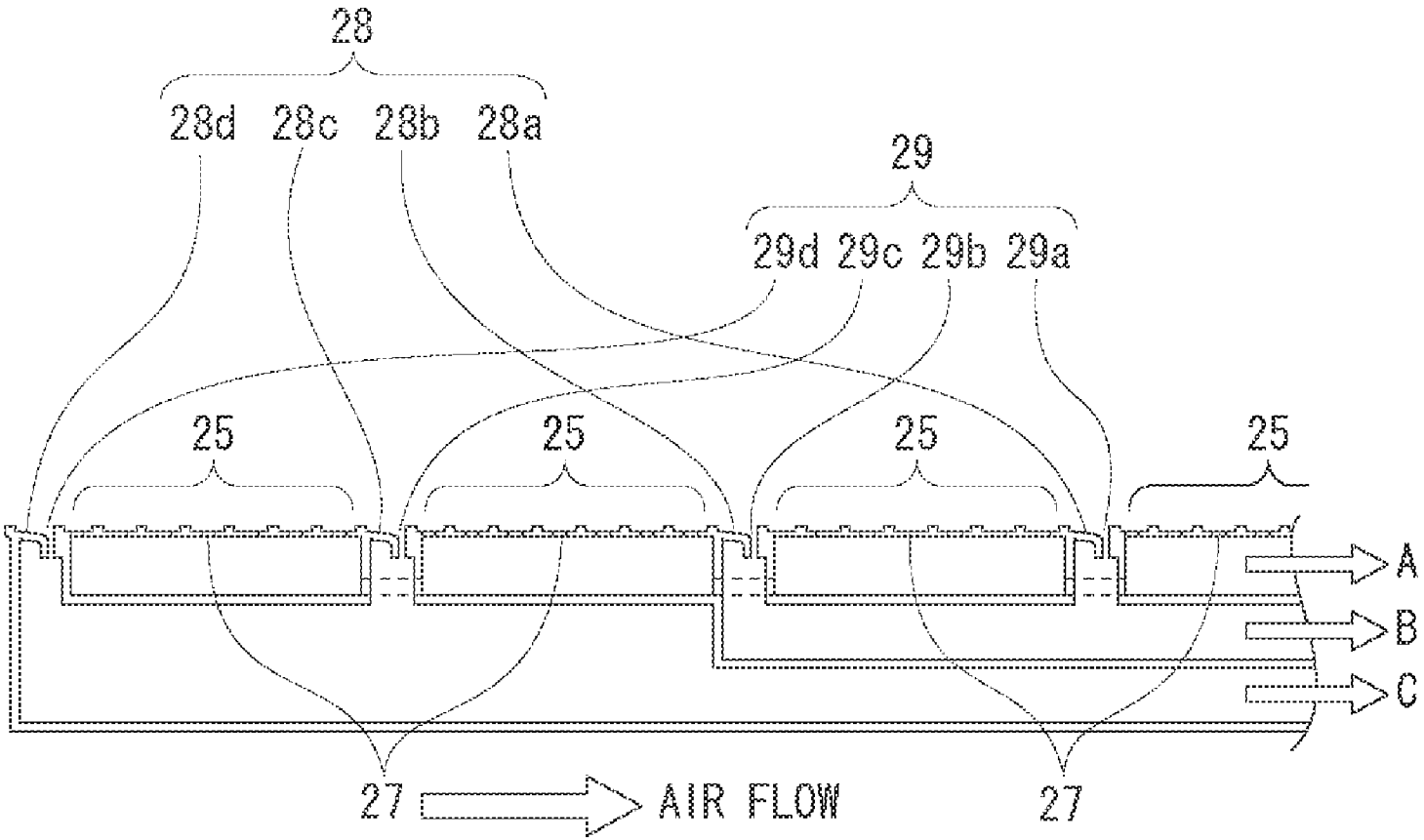
FIG. 8 illustrates a structure of the ducts according to a third exemplary embodiment.
Figure 9:
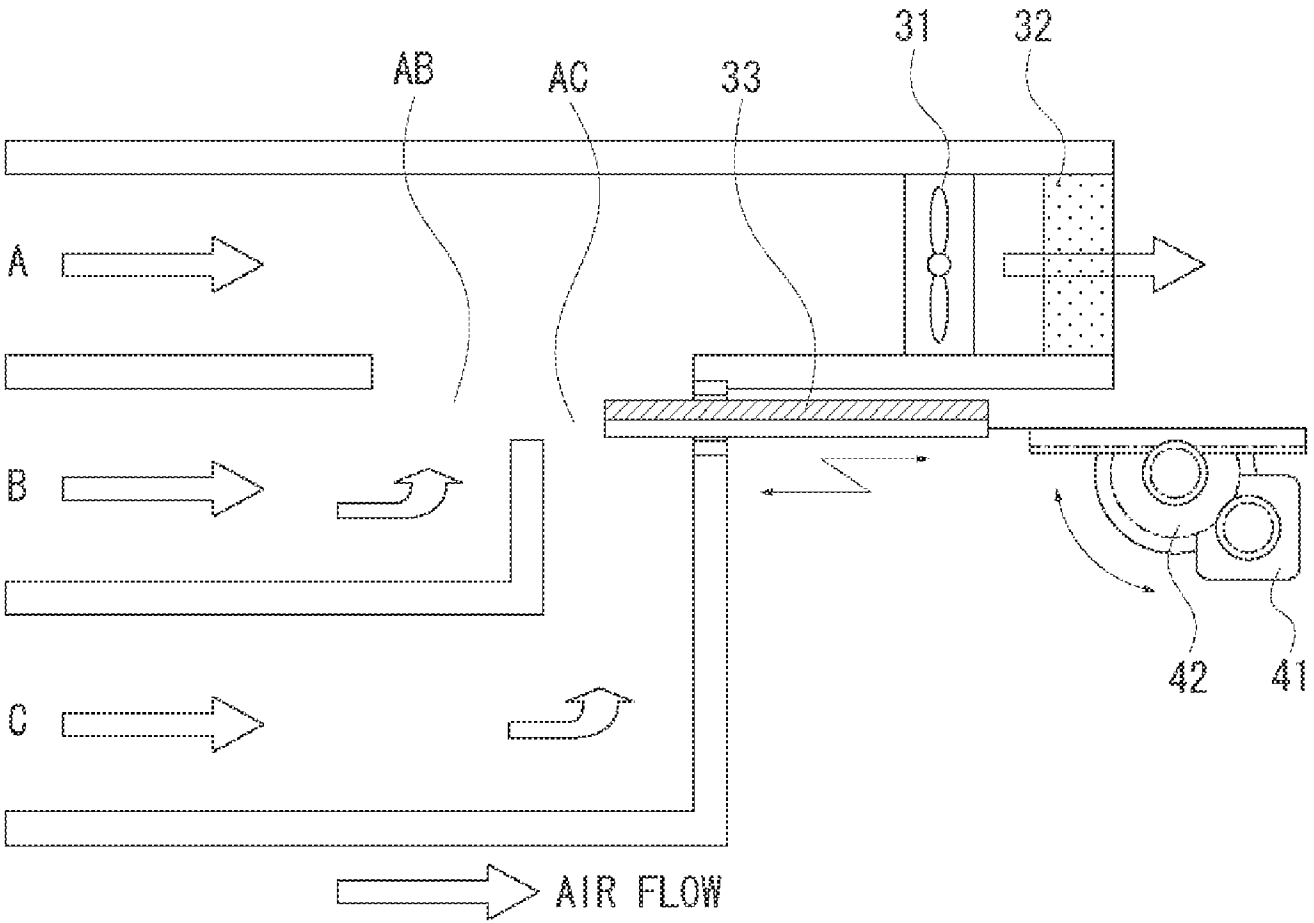
FIG. 9 illustrates a structure of the merging sections of the ducts and the negative pressure generation mechanism.

FIGS. 8 and 9 are schematic diagrams illustrating a third exemplary embodiment. A difference between the third exemplary embodiment and the first and second exemplary embodiments is that a plurality of collection opening 28 are divided into a plurality of groups according to a size of the sheet to be used, and the different duct is used for each group to supply the negative pressure.

In FIG. 8, similar to the exemplary embodiments described above, the plurality of all attraction portions 25 are connected to the duct "A". The collection openings 28 are divided into two groups. Of the collection openings 28*a*, 28*b*, 28*c*, and 28*d*, the collection openings 28*a* and 28*b* for the sheet having a small sheet size (a width in the main scanning direction is relatively small) are defined as a first group, and connected to the duct "B".

Further, the collection openings 28*c* and 28*d* for the sheet having a larger sheet size (a width in the main scanning direction is relatively large) are defined as a second group, and connected to a duct "C".

FIG. 9 illustrates a structure of the merging sections of the ducts and the negative pressure generation mechanism. The duct "B" merges with the duct "A" at the merging section AB. The duct "C" merges with the duct "A" at the merging section AC near the merging section AB. The fan 31 and the filter 32 included in the negative pressure generation mechanism are disposed at an end portion of the duct "A". The fan 31 is rotated to discharge the air to generate the air current and, thus, generates the negative pressure.

In this example, the duct "A" is the first duct, the duct "B" and a part of the duct "A" after merging at the merging section AB, and the duct "C" and a part of the duct "A" after merging at the merging section AC are the second duct. Near the merging sections AB and AC, the aperture mechanism 33 for changing an opening area of apart of the second duct is disposed.

The aperture mechanism 33 is automatically is automatically opened/closed by being moved right and left by the actuator including the driving force 41 and the rack and pinion mechanism 42 according to the instruction of the controller 15. More specifically, the aperture mechanism 33 can change the opening area of a part of the middle portion of the second duct (the merging sections AB and AC).

Further, it is possible to individually change the negative pressures to be supplied to the collection openings of the first and second groups through the second duct by the adjustment mechanism including the aperture mechanism 33 and the actuator. Furthermore, the negative pressure to be supplied to the attraction portion 25 can be also individually changed.

Figure 10:
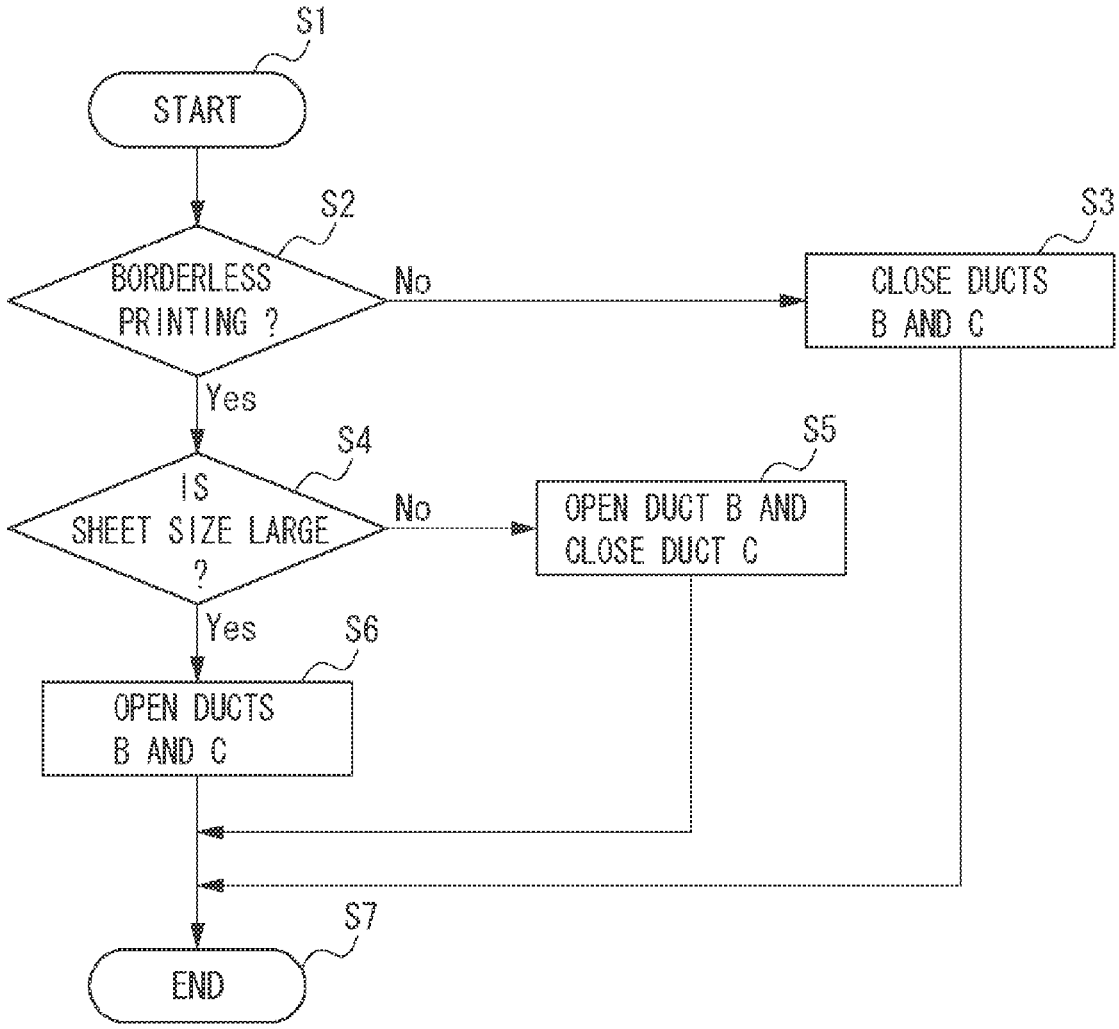
FIG. 10 is a flowchart illustrating an operation sequence of an ink jet printer.

The operation of the apparatus will be described. FIG. 10 is a flowchart illustrating an operation sequence for determining the state of the aperture mechanism 33. The controller 15 controls the aperture mechanism 33 to open/close according to the conditions, for example, the size of the sheet to be used and the bordered/borderless printing. The state is maintained during the print operation.

In step S1, the controller 15 starts to control the aperture mechanism 33. In step S2, it is determined whether the borderless printing is performed. When the bordered printing is performed (NO in step S2), the processing proceeds to step S3. When the bordered printing is performed, the negative pressure does not need to be supplied to the collection openings 28 in both of the first and second groups. In step S3, the aperture mechanism 33 is controlled to close both of the ducts "B" and "C".

Figure 11:
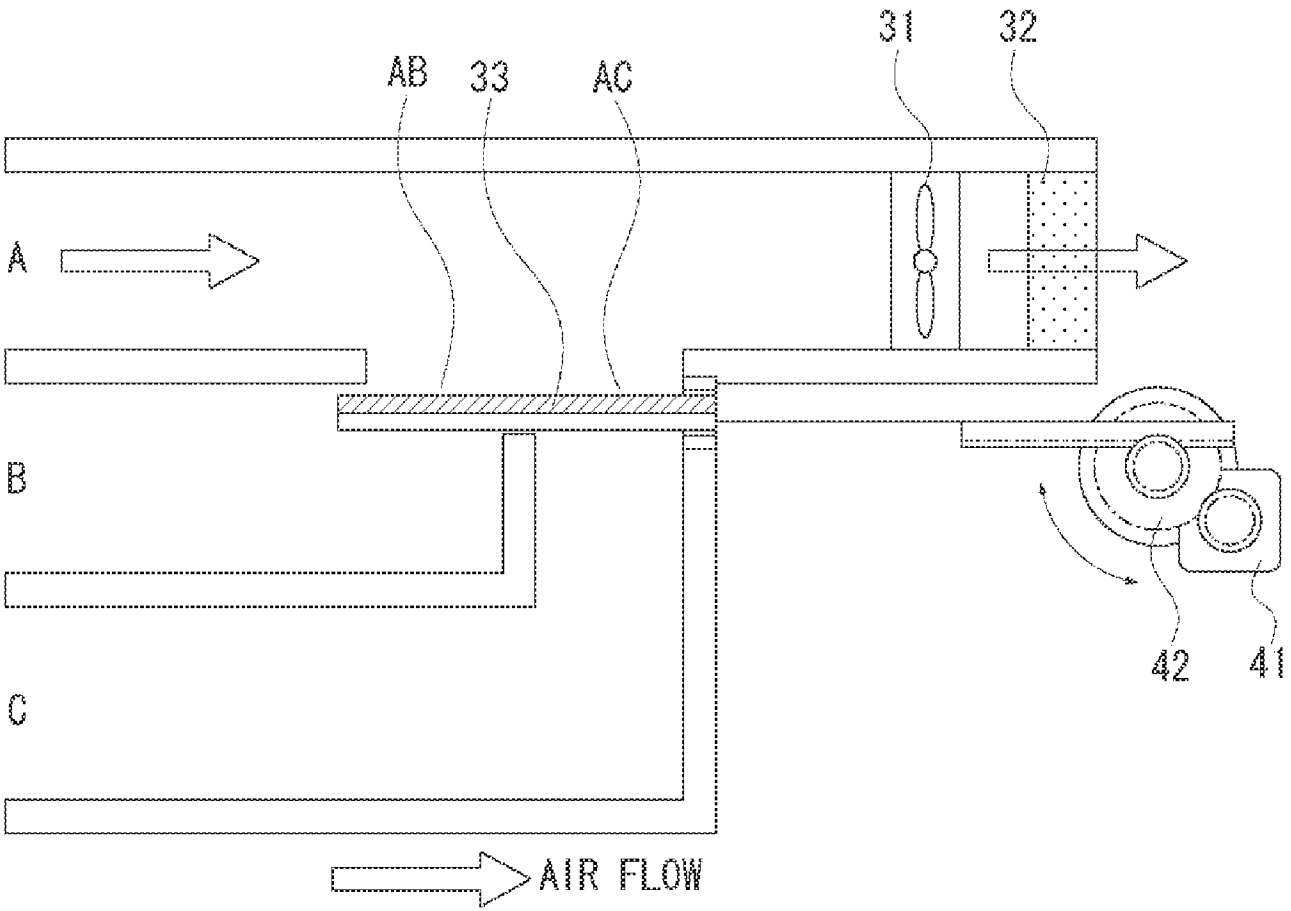
FIG. 11 illustrates a state of an aperture mechanism for bordered printing.

FIG. 11 illustrates the state of the aperture mechanism 33 when the bordered printing is designated. The aperture mechanism 33 slides left and stops when both of the merging sections AB and AC are closed. Accordingly, since the unnecessary air is prevented from being suctioned from the unnecessary collection opening 28, the negative pressure can be supplied more effectively to the attraction portion 25. After the aperture mechanism 33 is set, the processing proceeds to step S7 and ends.

When it is determined that the borderless printing is performed in step S2 (YES in step S2), the processing proceeds to step S4. In step S4, it is determined whether the size of the sheet (the width in the main scanning direction) to be used is large.

In step 4, when the sheet size is small (NO in step S4), the processing proceeds to step S5. Since the sheet size to be used is small, the negative pressure is supplied to the collection openings 28*a* and 28*b* of the first group for the small sheet size. The negative pressure is not supplied to the collection openings 28*c* and 28*d* of the second group for the large sheet size. In step S5, the aperture mechanism 33 is controlled to open the duct "B" and close the duct "C".

Figure 12:
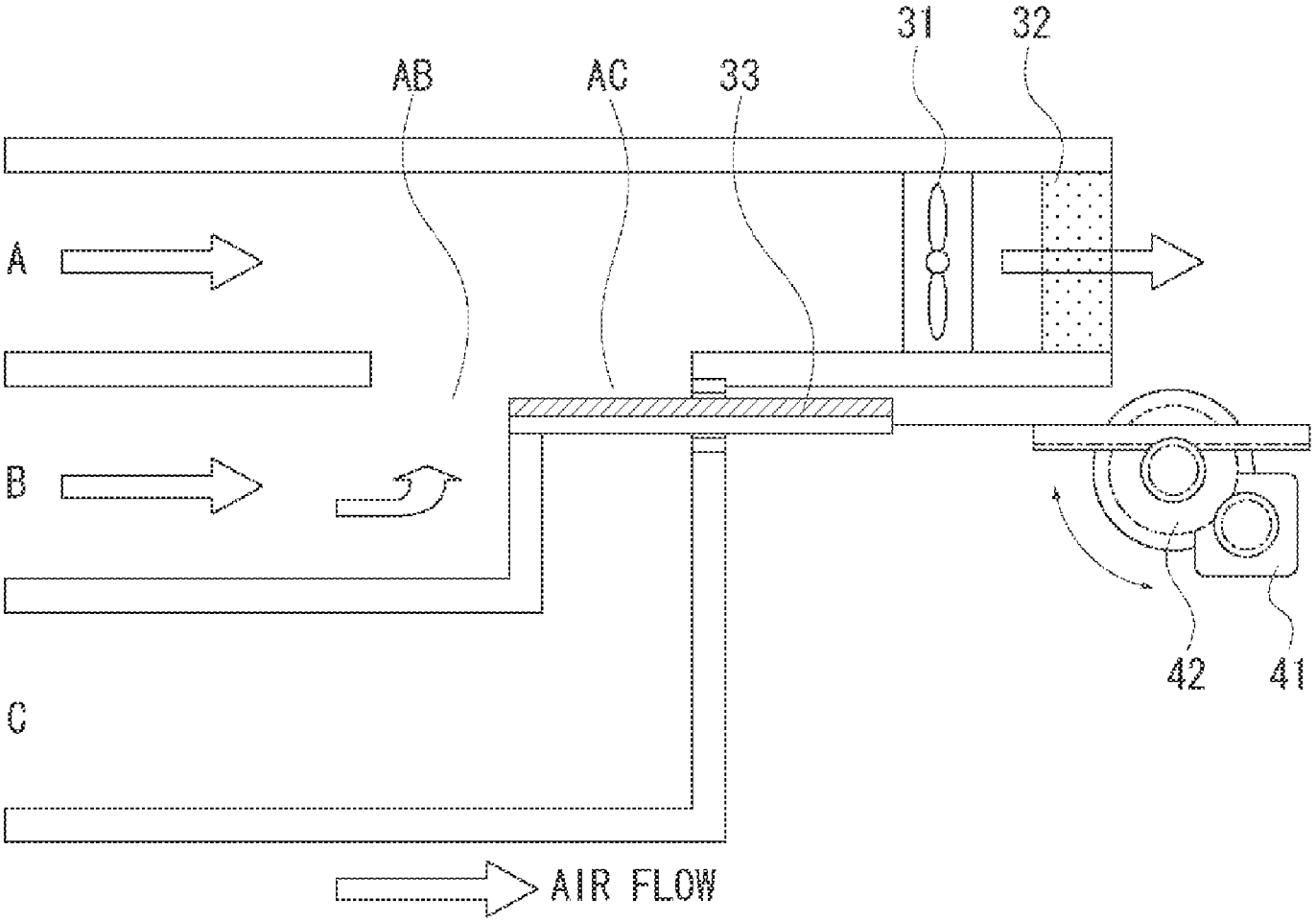
FIG. 12 illustrates a state of an aperture mechanism for borderless printing and a sheet having a small size.

FIG. 12 illustrates a state of the aperture mechanism 33 when the borderless printing is performed and the sheet size is small. The aperture mechanism 33 slides to a middle position where the merging section AB is opened and the merging section AC is closed, and stops there. With this arrangement, since the air is prevented from being suctioned from the unnecessary collection openings 28*c* and 28*d* of the second group, the negative pressure can be supplied more effectively to the attraction portion 25 and the collection openings 28*a* and 28*b*. After the aperture mechanism 33 is set, the processing proceeds to step S7 and ends.

In step S4, when the sheet size is large (YES in step S4), the processing proceeds to step S6. Since the sheet size of the sheet to be used is large, the negative pressure is supplied to the collection openings 28*c* and 28*d* of the second group for the large sheet size. Further, since the collection openings 28*a* and 28*b* of the first group are located inside the sheet having the large sheet size, the negative pressure is also supplied as an aid for attracting the sheet. In other words, the negative pressure is supplied to all of the collection openings 28 and the attraction portion 25. In step S6, both of the ducts "B" and "C" are opened.

Figure 13:
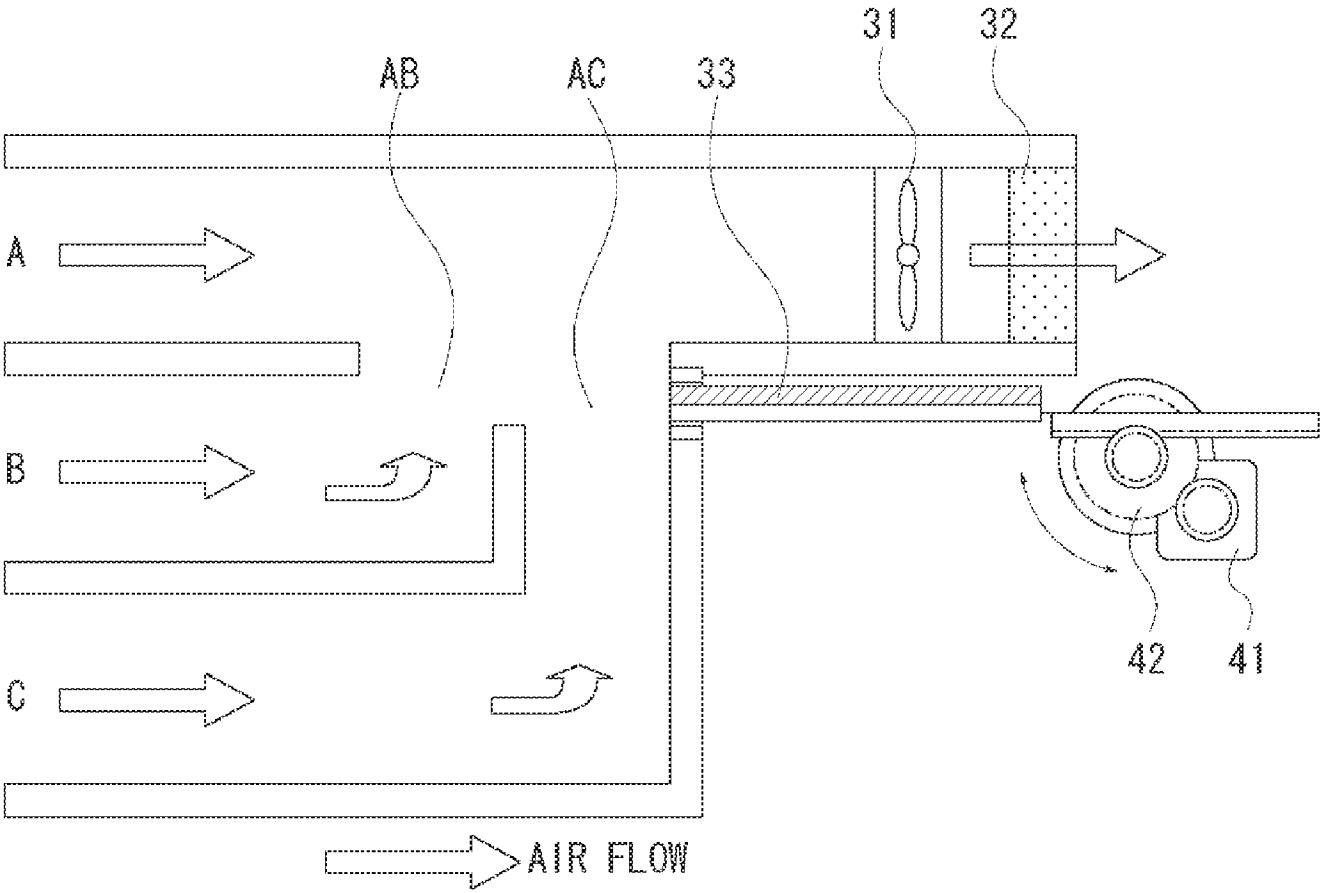
FIG. 13 illustrates the aperture mechanism for the borderless printing and a sheet having a large size.

FIG. 13 illustrates the aperture mechanism 33 when the borderless printing is performed and the sheet size is large. The aperture mechanism 33 slides to a position where both of the merging sections AB and AC are opened, and stops there. With this arrangement, the floating ink mist generated near the collection openings at the end portion of the sheet having the large sheet size can be effectively suctioned and collected. Simultaneously, the attraction portion 25 and the collection openings 28*a* and 28*b* attract the sheet.

The actuator that performs the control described above is controlled according to the instruction of the controller 15. Since other structures and operations are similar to those of the first exemplary embodiment, the descriptions will not be repeated.

According to the present exemplary embodiment, the collection openings are divided into two groups of the first and second groups according to the sheet size, however, the present invention is not limited thereto. The collection openings may be divided into a plurality of groups, which are three or more groups for each sheet size, and connected to the negative pressure generation mechanism through the different ducts relative to each group. The negative pressure to be supplied to each group may be individually changed.

When the collection openings are divided into three or more groups, if two of the three groups are regarded as the first group and the second group, the groups are controlled in the similar relationships as described above.

According to the present exemplary embodiment, in addition to the effects of the previous exemplary embodiments, the floating ink mist can be suctioned and collected from the appropriate collection opening even when the sheets having the different size is used. Thus, the printer having highly improved conveniences can be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-038050 filed Feb. 20, 2009, which is hereby incorporated by reference herein in its entirety.

What is claimed is:

1. An ink jet printer comprising:

a platen including an attraction portion configured to attract a sheet to be printed and a collection opening for collecting ink discharged outside the sheet;

a negative pressure generator configured to be used in common to generate a negative pressure to be supplied to each of the attraction portion and the collection opening;

a first duct configured to connect the negative pressure generator and the attraction portion;

a second duct configured to connect the negative pressure generator and the collection opening; and an adjustment mechanism configured to change a negative pressure to be supplied to the attraction portion through the first duct and a negative pressure to be supplied to the collection opening through the second duct, wherein the adjustment mechanism includes an aperture mechanism configured to change an opening area of a part of the second duct to adjust a negative pressure to be supplied to the collection opening through the second duct, and wherein the second duct merges with the first duct at a half way thereof, a part of the second duct shares a part of the first duct, and the aperture mechanism is disposed near a merging position where the first duct merges with the second duct.

2. The ink jet printer according to claim 1, wherein the aperture mechanism is moved by an actuator.

3. The ink jet printer according to claim 1, wherein ability of the negative pressure generator is changeable to adjust a negative pressure to be supplied to the attraction portion through the first duct.

4. The ink jet printer according to claim 3, wherein the negative pressure generator includes a fan that discharges air from the first and second ducts, and a rotation speed of the fan is changeable.

5. The ink jet printer according to claim 3, further comprising a controller configured to control the negative pressure generator according to characteristics of a sheet to be used.

6. The ink jet printer according to claim 1, further comprising a controller configured to adjust the adjustment mechanism such that a negative pressure supplied to the collection opening is different depending on whether bordered printing or borderless printing is performed.

7. The ink jet printer according to claim 6, wherein the controller performs control so that the negative pressure supplied to the collection opening when the borderless printing is performed is larger than that when the bordered printing is performed.

8. An ink jet printer comprising:

a platen including an attraction portion configured to attract a sheet to be printed and a collection opening for collecting ink discharged outside the sheet;

a negative pressure generator configured to be used in common to generate a negative pressure to be supplied to each of the attraction portion and the collection opening;

a first duct configured to connect the negative pressure generator and the attraction portion;

a second duct configured to connect the negative pressure generator and the collection opening; and an adjustment mechanism configured to change a negative pressure to be supplied to the attraction portion through the first duct and a negative pressure to be supplied to the collection opening through the second duct, wherein the collection opening is provided at a plurality of positions according to a plurality of sheet sizes, wherein a plurality of the collection openings are divided into a plurality of groups according to sheet sizes to be used, wherein the second duct includes a plurality of ducts connected to the negative pressure generator as a different duct corresponding to each of the groups, and wherein the adjustment mechanism changes a negative pressure to be supplied to each of the groups.

9. The ink jet printer according to claim 8, wherein the plurality of groups include a first group for a small sheet size and a second group for a large sheet size larger than the small sheet size, wherein, when the large sheet size is used for printing, the negative pressure is supplied to both of the first group and the second group, and wherein, when the small sheet size is used for printing, the negative pressure is supplied to the first group and a negative pressure supplied to the second group is decreased compared to that when the large sheet size is used.

10. The ink jet printer according to claim 8, wherein the second duct includes an aperture mechanism configured to be used in common to individually change an opening area of a part of each duct of the plurality of ducts.

11. An ink jet printer comprising:

a platen including an attraction portion configured to attract a sheet to be printed and a collection opening for collecting ink discharged outside the sheet;

a negative pressure generator configured to be used in common to generate a negative pressure to be supplied to each of the attraction portion and the collection opening;

a first duct, and a second duct which merges with the first duct at a halfway thereof, each of the first duct and the second duct provides the negative pressure generated by the negative pressure generator to each one of the attraction portion and the collection opening; and an aperture mechanism having an opening provided in the second duct through which an air flows, a state of the opening is changeable.

12. The ink jet printer according to claim 11, wherein the opening is disposed near a merging position where the second duct merges with the first duct.

13. The ink jet printer according to claim 12, wherein the aperture mechanism is moved with an actuator to change a size of the opening.

14. The ink jet printer according to claim 11, wherein a negative pressure to be supplied through the second duct is adjusted by the state of the opening.

15. The ink jet printer according to claim 14, wherein ability of the negative pressure generator is changeable to adjust a negative pressure to be supplied to the attraction portion through the first duct.

* * * * *